US005265352A

United States Patent [19]

Chemello

[11] Patent Number: 5,265,352

[45] Date of Patent: Nov. 30, 1993

[54] SKI BOOT EQUIPPED WITH A DEVICE FOR IMMOBILIZING THE UPPER IN ITS PIVOTING MOTION

[75] Inventor: Jean-Pierre Chemello, Annecy-Le-Vieux, France

[73] Assignee: Salomon S.A., Chavanod, France

[21] Appl. No.: 907,021

[22] Filed: Jul. 1, 1992

[30] Foreign Application Priority Data

Jul. 1, 1991 [FR] France ..... 91 08503

[51] Int. Cl.[5] ..... A43B 5/04

[52] U.S. Cl. ..... 36/117; 36/120; 36/121

[58] Field of Search ..... 36/117, 118, 119, 120, 36/121

[56] References Cited

U.S. PATENT DOCUMENTS

| | | | |
|---|---|---|---|
| 4,499,676 | 2/1985 | Chalmers, II | 36/117 |
| 4,622,765 | 11/1986 | Baratto et al. | 36/120 |
| 4,841,649 | 6/1989 | Baggio et al. | 36/119 |
| 4,928,406 | 5/1990 | Montfort | 36/117 |
| 5,001,851 | 3/1991 | Baggio et al. | 36/117 |
| 5,031,341 | 7/1991 | Paris et al. | 36/120 |
| 5,065,533 | 11/1991 | Paris | 36/120 |
| 5,075,983 | 12/1991 | Mabboux et al. | 36/117 |
| 5,136,794 | 8/1992 | Stampacchia et al. | 36/117 |

FOREIGN PATENT DOCUMENTS

| | | | |
|---|---|---|---|
| 0086908 | 8/1983 | European Pat. Off. . | |
| 0286586 | 10/1988 | European Pat. Off. . | |
| 0358599 | 3/1990 | European Pat. Off. | 36/117 |
| 2619317 | 2/1989 | France . | |

*Primary Examiner*—Steven N. Meyers
*Assistant Examiner*—M. D. Patterson
*Attorney, Agent, or Firm*—Pollock, Vande Sande & Priddy

[57] ABSTRACT

The boot (1) comprises a device (35) immobilizing the upper (2) in a front-to-rear direction and acting on an oscillating lever (11) capable of resting on a stop (13) on the shell base (5). The device is constituted by an externally controlled rotating mechanism (10) (18), an inner part (19) of which controls, through a cam (19*a*), a sensing device (11*b*) associated with the oscillating lever (11), in order to impart to the latter an angular pivoting motion around its pin (12) toward a locked or a released position, in relation to the stop (13) on the shell base (5).

11 Claims, 6 Drawing Sheets 4
2
3
16
7a
9a
8a
17
20
22
7b
18a
19b
9b
10
19a
8b
19c
35
F1
X
21
X'
19
7c
25
18
11b
9c
18b
24
8c
16b
16
12
11
16a
14
15
13
11a
5
1
6

4
2
3
16
16b
17
22
18a
10A
x F1
18
36
20
16
14
1
13
6
40d
12 A
24
41
x'
19
40a
25
40b
40
40c
7a
9a
8a
7b
9b
8b
7c
9c
8c
5

SKI BOOT EQUIPPED WITH A DEVICE FOR IMMOBILIZING THE UPPER IN ITS PIVOTING MOTION

FIELD OF THE INVENTION

The present invention relates to an alpine ski boot comprising a rigid shell, with a shell base surmounted by an upper at least partially jointed on the latter and comprising from which itself comprising opening means allowing insertion of the foot and an assembly for closing the upper over the lower part of the leg and comprising a tightening system incorporating at least one traction element enclosing the upper at least partially, so as to be placed under tension by at least one tension device attached to at least one of the parts composing the upper.

More specifically, the invention relates to means for immobilizing the upper in a front-to-rear direction, which comprise a control mechanism acting on a lever which, pivoting around a transverse axis belonging to the rear portion of the upper, pivots between two positions, one in which a portion of the lower end of the lever is stopped against a rear stop on the shell base in the heel area or in an selected forwardly-inclined position of the upper, which corresponds to a skiing position, and the other in which this lower part is released from the rear stop on the shell base so as to free the upper from any stress caused by its angled positioning, in which case the control mechanism acts on another portion of the pivoting lever in opposition to an elastic device.

BACKGROUND OF THE DEVICE

To this end, Patents Nos. EP-A-286 586 and EP-A-286 586 disclose locking means of the aforementioned type, in which the lower end of a rocker is stopped on a lower portion of the boot, so as to force the upper of the boot to adopt an inclination, widely termed an "angle of overhang," which is essential for skiing. An upper end of the rocket has the shape of a press button designed to allow the release of the rocker when the skier wishes to straighten his leg or to walk.

When the skier wishes to resume skiing, he flexes the leg in order to bring the upper back into an inclined position. The locking action is then effected automatically once again, without any manual operation.

The disadvantage of this system lies in the fact that, during walking, for example in the released position, undersired automatic locking can occur, in particular when climbing a slope liable to cause a forward pivoting motion of the upper. This is due to the absence of a stable release position.

It will be easily understood that repeated manual release operations can prove tiresome for the skier.

To overcome this major, important disadvantage, proposals have been advanced suggesting manual means for releasing the aforementioned rocker which can immobilize the latter in a stable position corresponding to the release of the boot upper, as disclosed in FR-A 2 648 327. According to this document, the manual release means are constituted by a piece moving in vertical translational motion at the upper end of one of the rocker arms and capable of being manually actuated in an upward sliding movement, so as to extend this upper end of the rocker and to cooperate with a notch provided in the upper portion of a recess in the upper, in order to hold the rocker in the released position. A slide control assembly at the bottom of this mobile part has the effect of releasing this piece from the upper notch and of allowing it to pivot when acted upon by an elastic device, so that the lower end of said bascule is stopped on the aforementioned stop provided on the rear of the shell base, in operating position.

To permit manipulation of the mobile part in translational motion in either direction, this part has a projecting portion forming an outer gripping device, without which no control would be possible.

These locking means have a number of drawbacks, one of which lies in the fact that, whether the mobile device is in the locked or released position, the outer gripping device must always remain in a projecting configuration to permit access to it, and thus forms an aggressively protruding part capable of causing accidents. Another difficulty relates to design, since it becomes necessary to provide, on the one hand, a bascule which is relatively thick because it supports the mobile part and the gripping device attached to it, and, on the other hand, an upper notch to be cut in the upper.

Finally, as regards use, this system always requires two operations to produce a stable release of the boot upper, i.e., a rectilinear thrusting movement perpendicular to the upper in order to cause the rocker to pivot in a movement which releases its lower end from the stop, and a thrusting movement, also rectilinear and substantially parallel to the upper, so as to engage the mobile part beneath the upper notch.

This latter disadvantage does not occur in other conventional devices for immobilization of the upper of a boot, in which the locking, and indeed control, means are independent of the upper. For example, the ski boot described in French Patent Application No. 2 619 317 has upper-immobilization device comprising a stop means which is subjected to the continuous action of an elastic force which pushes it into its closed position, and which can be controlled in the open position in opposition to this force by means of a control mechanism located on the upper.

As illustrated, the stop means is housed in a recess in the upper, and takes the form of a double-arm lever pivoting around a pin mounted in the upper, while the control device is mounted so as to pivot externally to the upper, in proximity to the end of one of the arms of the stop lever.

In this type of construction, the release of the upper occurs as a result of an outer swinging movement of the control mechanism which, since it exerts pressure on the corresponding arm of the stop lever, produces the release of this lever from its stop on the shell base. To relock the upper in the skiing position, it then becomes necessary to bring the control mechanism back against the upper in order to permit the stop lever, under the effect of the elastic return force, to be placed in the engaged position in relation to its stop on the shell base.

As can be clearly seen, such an immobilization device has the disadvantage of protruding very appreciably on the rear part of the upper, and of requiring voluntary manipulation of the control mechanism in order to return to the locked position of the upper for the purpose of skiing.

The device for immobilization of a ski boot upper, as described in German Utility Model No. Gm 80 20 898 may also be cited as an example. In this document, the locking device incorporates a lever attached to the upper which can be stopped on an element of the boot shell. This lever is actuated using an external traveller capable of moving linearly and of acting angularly on the position of the lever from an end or central articulation point.

As in the preceding description, this device has the disadvantage of protruding permanently and variably from the rear portion of the upper, since the traveller can be moved in translational motion. Furthermore, this device always involves a voluntary operation performed by the skier, so as to travel from the released to the locked position for skiing. Here again, there is no possibility for a momentary release manoeuver and the opportunity for automatic relocking.

SUMMARY OF THE INVENTION

The object of the present invention is to overcome these various difficulties and to propose, to this end, a device for immobilizing the upper of a ski boot which is capable:

- of immobilizing, permanently and in stable fashion, the upper of the boot in relation to the shell base for skiing;
- of releasing this upper, also permanently and in stable fashion, to allow the unrestricted use of the boot for walking; and
- of momentarily releasing the upper alone, to allow the boot to be removed or to permit the skier to adopt a standing relaxed position, advantageously combined with automatic relocking in the skiing position as soon as the control device is released and the upper is returned to its original, angled skiing position.

Another purpose of the invention is to propose a device whose control mechanism is inserted into the volume of the rear part of the upper. To this end, the control device is accessible either around its circumference or through its visible surface, and it adopts a single position in the rear part of the upper, whatever the operation performed, i.e., permanent locking, momentary release, or permanent release.

According to the invention, the alpine ski boot comprises a shell base surmounted by an upper which incorporates a front and rear part produced from one or several pieces, the rear part of this upper being capable of pivoting at least partially from back to front and/or from front to back, and comprising a device ensuring immobilization in relation to the shell base for at least one of the aforementioned pivoting directions, by means of a stop and/or gripping area on the shell base.

According to one feature of the invention, the immobilization device can be maneuvered using a control mechanism belonging to a swinging lever constituted by a rotating element which can turn in a coaxial housing forming a bearing provided in this rear part of the upper, and in which this freely rotating element is secured independently of the swinging lever subjected to the action of a return spring. The rotating element comprises an outer gripping part whose rotation is manually controlled, and an inner part acting, by means of a cam, on a sensing device which secures the pivoting lever, both of the aforementioned parts being connected by means of a cylindrical pin housed in the bearing incorporated into the upper.

According to another feature of the invention, the cam is composed of a cylindrical part centered on the rotating element and is attached to the end of the internal part of the latter or of the oscillating lever. It is obvious that a sensing device designed to cooperate with the cam is thus mounted on the part not equipped with this cam. Moreover, the cam incorporates on its cylindrical circumference at least one inclined surface having a progressively increasing profile extending from a low sensing point to a high point extended by an area of position retention of the sensing device. The difference in height between the low and high sensing points is determined as a function of the engagement of the oscillating lever on the stop or gripping area on the shell base, and is at least sufficient to cause, by means of the sensing device, a pivoting movement of the oscillating lever which corresponds at least to the swivelling produced by its engagement on the shell base, and to release the upper from the boot.

According to a first embodiment, the cam comprises two progressive ramps, each of which extends from a low point of the cam to a common position-retention area where they meet. The device controlling the immobilization device associated with the cam can thus be actuated equally well in both directions of rotation, in order to cause the release of the boot upper in relation to the shell base.

According to a second embodiment of the aforementioned cam, the latter comprises, beginning at its low point and on one of its sides, a progressive ramp such as the one previously described, and, on the other side, a vertical wall or stop surface, against which the sensing organ abuts. In this type of construction, the device controlling the immobilization device can thus be operated in only one direction of rotation, i.e., that corresponding to the direction in which the inclined ramp extends.

According to a third embodiment, the cam incorporates two dissymmetrical ramps which extend beginning at the low point and on either side of the ramp. In this construction, one of the ramps is thus designed to allow permanent release, and the other, a momentary release. To this end, the first ramp ends, at a high release point of the cam, in an area of position retention of the sensing device, while the second inclined surface extends at least to the height of the high point of the first ramp, but comprises no area of position retention of the sensing device. Accordingly, when the cam moves in rotation on the side of this second ramp, the upper-immobilization device can be released, and its return to the original locked position can take place automatically as soon as the cam-operation device is disengaged. To facilitate the return to the locked position, the cam and/or the operating device can be advantageously equipped with an elastic return element. In addition, with or without this elastic return element, the unstable release ramp on the cam can be provided in a relatively inclined configuration so that, under the effect of the thrust of the return spring belonging to the oscillating lever, the bearing pressure of the sensing device on the latter facilitates its return to the original position on the low point as soon as the operating device is disengaged.

In these construction examples of a cam having two dissymmetrical ramps, only one of the directions of rotation applied to the control mechanism, whether to the right or the left, thus determines either the momentary release of the immobilization device, accompanied by an automatic return to the locked position upon disengagement, or the permanent release of this device, because of the position retention of the sensing device on the high point of the cam.

Still in accordance with the invention, the upper-immobilization device can be provided in order to secure the latter, in the direction of front-to-back pivoting alone or in the two directions of pivoting, i.e., front-to-back and back-to-front, in relation to the shell base. In the case of immobilization in the front-to-back direction only, the oscillating lever comprises a lug, or catch piece, which cooperates with a corresponding notch produced in the shell base, when the rear portion of the upper is brought into the functional skiing position. In addition, in the case in which it becomes necessary to leave a degree of free pivoting motion of the rear portion of the upper and/or of the upper prior to immobilization, in particular to control the amplitude of flection of the upper, for example toward the front, the slot extends vertically above the catch piece over a certain length determined by the thickness of the latter and the desired pivoting travel.

BRIEF DESCRIPTION OF THE DRAWINGS

Other features and advantages of the invention will emerge from the following description, provided with reference to the attached drawings illustrating, by way of example, various embodiments of the invention.

FIGS. 2*a*, 3*a*, 4, 5*a*, and 6*a* illustrate different embodiments of the cam, which is fastened to the control mechanism belonging to the immobilization device and which is shown:

in perspective in FIGS. 2 to 6, and laid out flat in FIGS. 2*a* to 6*a*.

Figure 7:
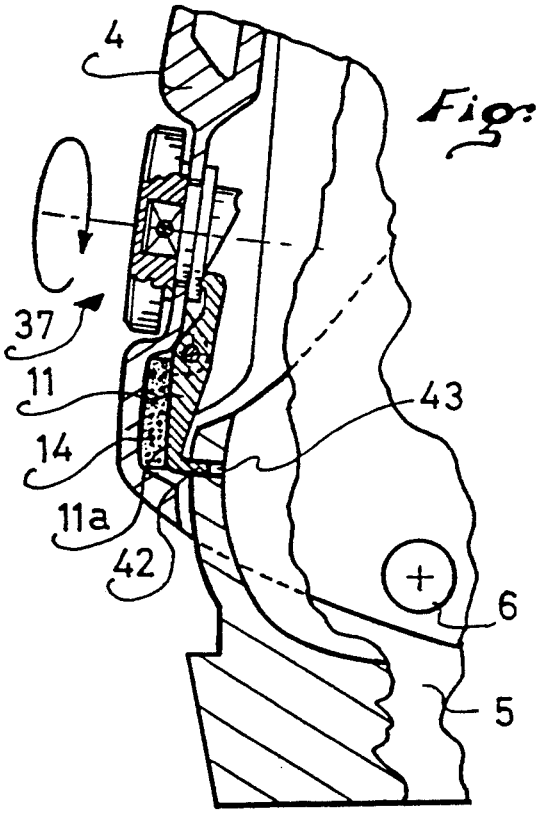
Figure 8:
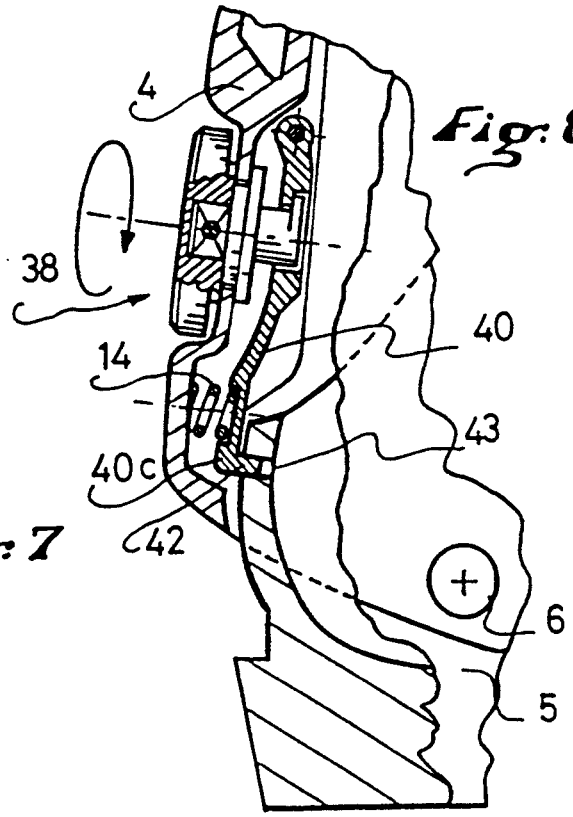
Figure 9:
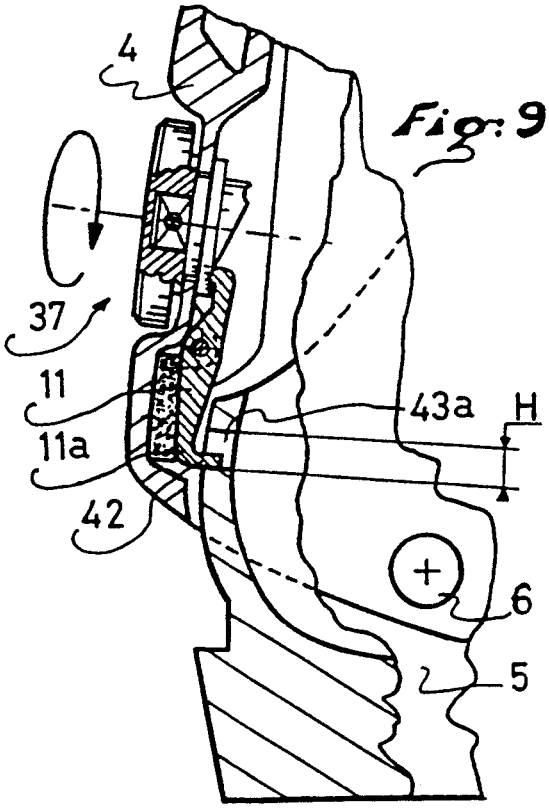

FIGS. 7, 8, and 9 illustrate variants of the stop means belonging to the immobilization device according to the invention, seen in vertical cross-section.

FIGS. 10, 11, 12, and 13 are side-views of various types of boots produced in accordance with the invention.

DESCRIPTION OF THE PREFERRED EMBODIMENT

Figure 1:
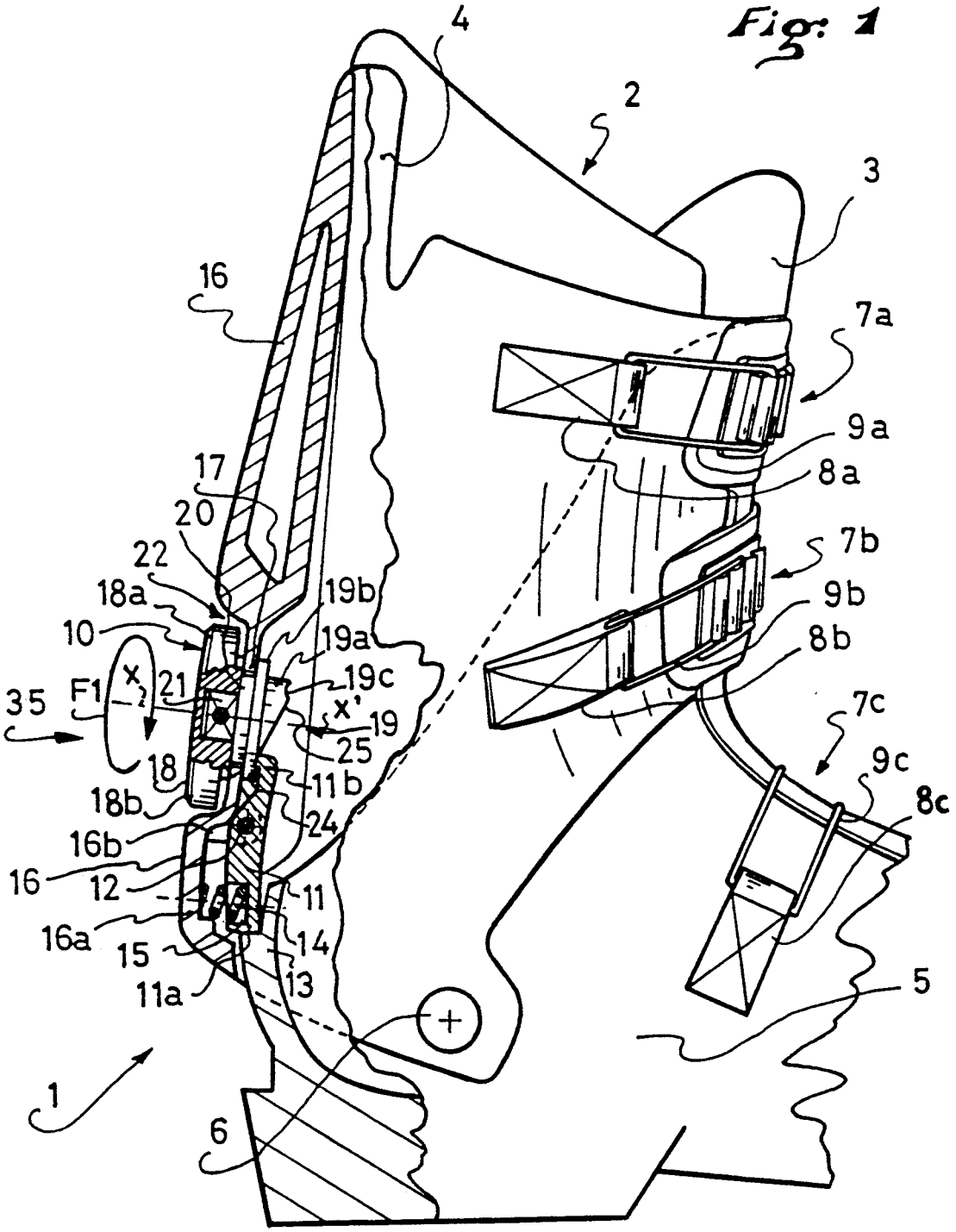
FIG. 1 is a side view of a ski boot, in which one part shows, in vertical cross-section, the device according to the invention and its immobilization means, shown in the locked position.

As an illustrative example, the boot 1, referenced in its entirety and shown in FIG. 1, is of the "rear entry" type.

According to the invention, the ski boot 1 comprises an upper 2 having a front part 3, or front cover, and a rear part 4, or rear cover, and a shell base 5 to which the rear part 4 of the upper 2 is attached by rivets 6, the rear part 3 of the upper 2 being constituted by an extension of the shell base 5.

A three-point tightening system 7*a*, 7*b*, 7*c* providing for closing the upper 2 over the lower part of the leg of the skier comprises, in conventional manner, three separate tension levers 8*a*, 8*b*, 8*c* which secure, under tension, traction components such as cable buckles 9*a*, 9*b*, 9*c* partially surrounding the front part of the upper 2 in order to be placed under tension by these tension levers 8*a*, 8*b*, 8*c*, which are fastened, in the case of levers 8*a* and 8*b*, to the lateral wings arising from the rear cover 4, and, in the case of lever 8*c*, to the front part of the boot.

According to the embodiment shown in FIG. 1, the boot 1 is provided with an immobilization device 35 of the upper 2 which acts only in the front-to-back direction. This immobilization device comprises a control mechanism 10 acting on an oscillating lever 11 which pivots around a transverse pin 12 secured in the rear part of the upper 2. The lever 11 swivels between two positions, one of said positions being a skiing position in which a portion of the lower end 11*a* of the lever 11 is stopped against a rear stop 13 on the shell base 5 in the area of the heel for a selected forward-inclined position of the upper, and in the other of said positions this lower part 11*a* escapes from the rear stop 13 on the shell base 5 so as to free the upper from any angled positioning stress, a rotating control mechanism 10 then acting on another part 11*b* opposite the end 11*a* of the oscillating lever in opposition to an elastic device 14, which is arranged in a housing 15 in the lower part 11*a* of the lever 11 and acts in a reactive manner against a lower part 16*a* of a stiffening brace 16 forming the wall of the rear cover 4 of the upper 2. The pin 12 of the lever 11 is supported by a tab 16*b* fastened to the stiffening brace 16. The rotating control mechanism 10 associated with the oscillating lever 11 can turn in a coaxial housing 17 forming a bearing in this rear part 4 of the upper 2, and in which the freely rotating device 10 is secured independently of the oscillating lever. To this end, the arranged side of the wall of the brace 16, an outer gripping part 18 whose rotation can be manually controlled, and an inner part 19 which acts by means of a cam 19*a* on part 11*b* of the oscillating lever 11, which in fact constitutes the sensing device of the cam, the two parts 18 and 19 being connected by a cylindrical bearing surface 20 housed in the bearing 17 in the upper.

In accordance with the present embodiment, the cam 19*a* is constituted by the frontal end itself of the inner part 19 of the rotating control mechanism 10, and it acts on the end 11*b* of the lever 11 opposite its lower end 11*a*. The transverse pin 12 is positioned between these ends 11*a*, 11*b*.

The frontal cam 19*a* of the control mechanism 10 is preferably hollow, i.e., comparable to the end of a tube, and is formed from an inclined plane forming a ramp whose peripheral area is in continuous contact with one of the ends 11*b* of the oscillating lever 11. This cam incorporates a low point 24 and a high point 25 corresponding, respectively, to a position of immobilization along the front-to-back or back-to-front direction, and to a position of angular freedom of the cam for a degree of angular rotation in one direction or the other applied to the gripping element 18 on the rotating control mechanism 10.

In the present example, moreover, the gripping element 18 on the rotating control mechanism 10 is constituted by a flywheel whose ribs 18*a*, 18*b* are arranged radially in relation to the longitudinal axis X—X' of this mechanism 10 and form a planar angle.

Gripping element 18 may have another shape, e.g., an overall circular drum shape. In any event, it is rigidly attached to its cylindrical pin 20, e.g., by means of a driving square 21, and it. It must be noted that the gripping element creates a volume of revolution which corresponds substantially to that of a housing 22 provided in the upper 2, in which this gripping component 18 is placed, remaining in a single plane, with no offset in relation to the outer wall of the upper 2, whatever the position of the cam 19*a* relative to the oscillating lever 11.

Position retention of the rotating control mechanism 10 on the wall 16*a* of the upper 2, this wall here forming a part of the stiffening brace 16, is ensured by clamping this wall between the gripping component 18 and a circular shoulder 19b belonging to the inner part 19 forming the cam 19a.

In addition, the highest part of the cam 19a comprises a recess, or area of position retention 19c matching the cup-shaped high release point, in which the corresponding end 11b of the lever 11 can be positioned so as to provide a stable released position. This position is reached by exerting a single rotation, in the direction Fl around the axis X—X', on the ribs 18a, 18b of the gripping element 18.

The rotation of the cam 19a thus exerted then drives the end 11b of the lever 11 in an angular movement around its pin 12, to an extent such that the difference in height between the low point 24 of the ramp and its high point 25 matches, at a minimum, a pivoting angle of the lever 11 which allows its lower part 11a to escape from the stop 13 in order to adopt a release position capable of freeing the angular swivelling motion of the rear portion 4 of the upper 2.

Figure 1A:
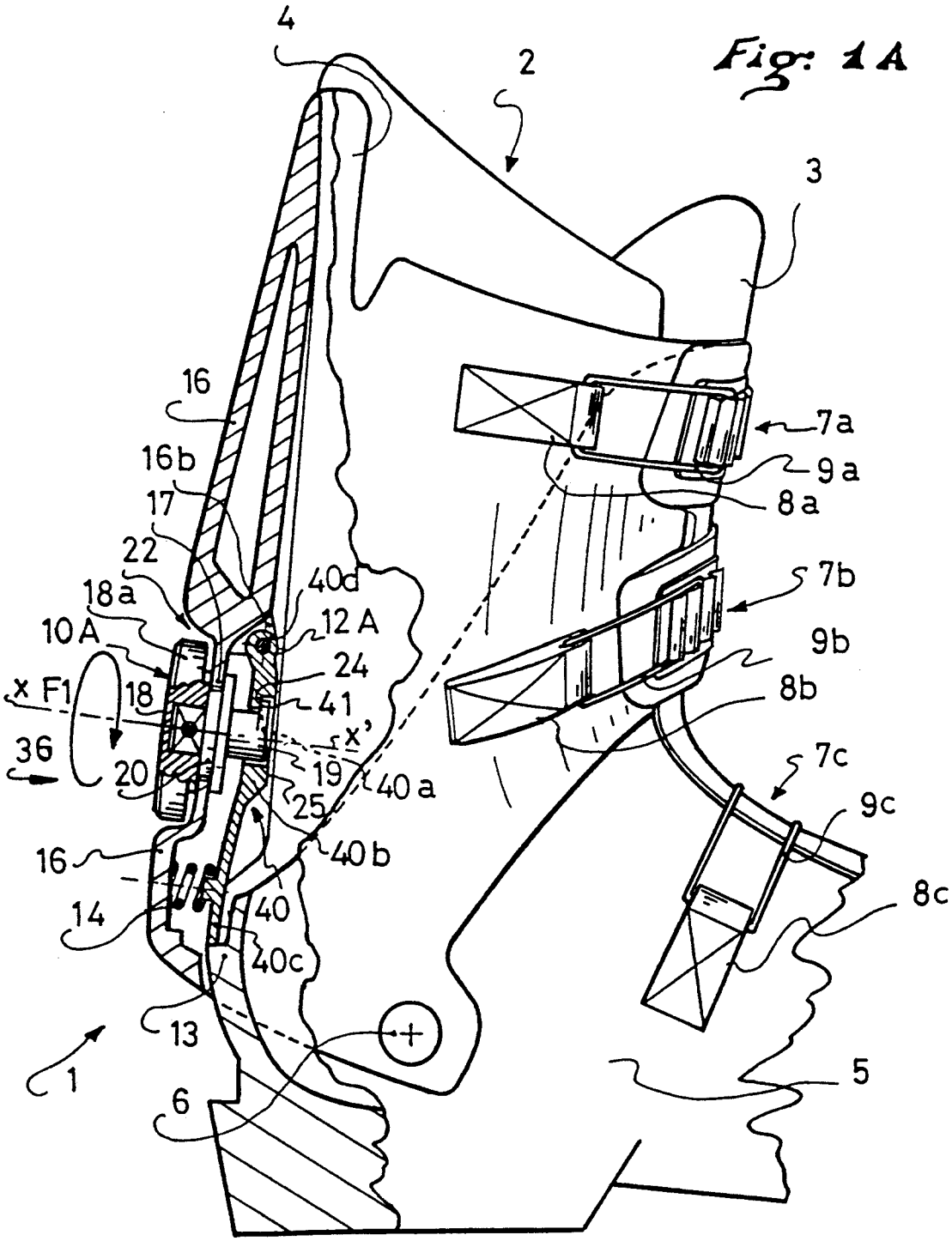
FIG. 1A is a side view of a ski boot analogous to that in FIG. 1, but fitted with another device still in accordance with the invention.

According to another embodiment illustrated in FIG. 1A, the immobilization device 36 differs fundamentally from the previous embodiment in that the cam 40a, which is formed from a cylindrical component centered on the rotating element 10 and whose cylindrical periphery comprises at least one ramp, is arranged on an intermediate part 40b of the lever 40 positioned between the transverse pin 12A set in one end 40d of the lever 40, and another, opposite end 40c of the same lever 40 capable of coming into contact with the stop 13 in the locked configuration, this cam 40a being in continuous contact with a radial control finger 41 acting as the sensing device connected with the control mechanism 10A. This ramp comprises a low point 24 and a high point 25 which, as in the preceding embodiment, correspond respectively to a forward position of immobilization of the upper 2 or to a reversed position of angular freedom of this upper as a result of a degree of rotation applied in one direction or the other to the gripping element 18 of the rotating control mechanism 10A, which exerts force on this cam 40A so as to cause the aforementioned angular movement of the lever 40.

Cam 40A can be positioned, not on a portion of the lever 40, but on one element of the inner portion 19 of the rotating control device 10A, for example at its end, in the form of a collar (not shown) forming an inclined plane. In this case, the lever 40 incorporates a sensing device, such as a lug radial to the cam 40A.

In accordance with the invention, the cam 19a and/or 40a may have profiles which differ as a function of the rotational control direction(s) specified, as well as of the amplitude of the desired rotational movement, so as to travel from a locked position to a release position, and/or vice-versa.

In the FIGS. 2 to 6 and 2a to 6a, several embodiments of the profile of a cam 19a, of the type shown in FIG. 1, are illustrated as examples. These embodiments are obviously applicable to a cam 40a belonging to the device shown in FIG. 1A.

Figure 2:
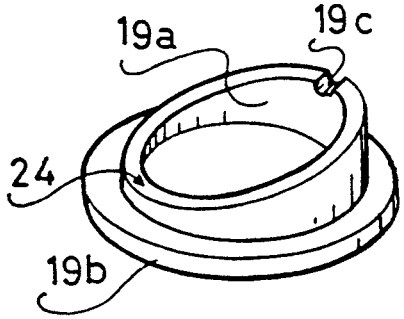
FIGS. 2, 3, 4, 5, and 6 and associated
Figure 2A:
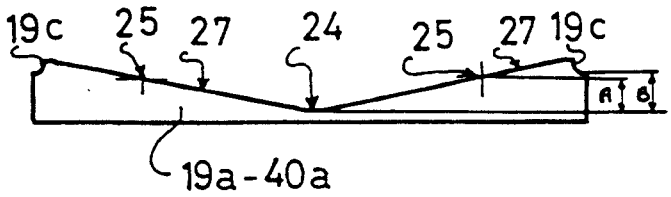
Figure 3:
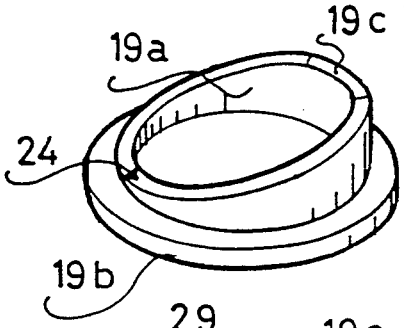
Figure 3A:
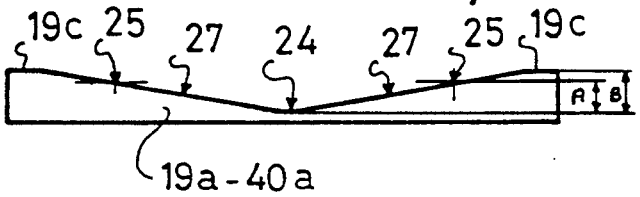

In FIGS. 2, 2a and 3, 3a, the cam 19a has two symmetrical ramps 27, each of which rises gradually from the low point 24 to the area of position retention 19c, while passing through a high release point 25. As previously explained, the difference in height between the low point 24 and the high point 25, referenced as "A" in FIGS. 2a and 3a, is a function of the engagement of the lower end part 11a of the lever 11 against the stop 13 on the shell base 5, as illustrated in FIG. 1. In accordance with the invention, this difference in height actually matches the value of the swivelling movement of the end 11b of the lever 11 required to release the upper 2 in relation to the shell base 5. The difference in height "A" is always less than, or equal to, the difference in height between the low point 24 and the area of position retention 19c designated by the letter "B". In the embodiment of the cam 19a shown in FIGS. 2 and 2a, the area of position retention 19c is advantageously given material form by a notch in which the sensing device is designed to latch, thereby ensuring a stable release position of this device and gearing the rotation of this cam 19a in the release position of the upper 2 of the boot. As shown in FIGS. 3 and 3a, the area of position retention 19c may constitute a simple flat support surface. In these two embodiments of the cam 19a (FIGS. 2, 2a, 3 and 3a), the latter can be equally well maneuvered, beginning at the low point 24, in the two directions of rotation, so as to release the boot upper. To obtain an unstable release position using this cam, the area of position retention 19c is advantageously positioned beyond the release point. Accordingly, simply by turning the cam 19c from its low point 24 to its high point 25 by using the rotating device 10, and then disengaging it before it reaches the area of position retention 19c, the boot upper is momentarily released at the instant when the sensing device 11b reaches the high point 25. After disengagement of the rotating control mechanism 10, the cam 19c can then be returned to the locked position under the effect of the force exerted by the sensing device on the corresponding ramp of the latter. Furthermore, the cam can be returned to the locked position under the effect of an elastic return element (not shown), which can be inserted between the rotating device 10 and the wall of the rear cover 4 on which it is held in place. This structure is compatible with a cam comprising a position-retention notch 19c which ensures a stable release position when this is desired, despite the elastic return action.

Figure 4:
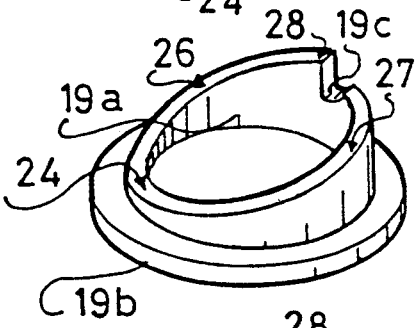
Figure 4A:
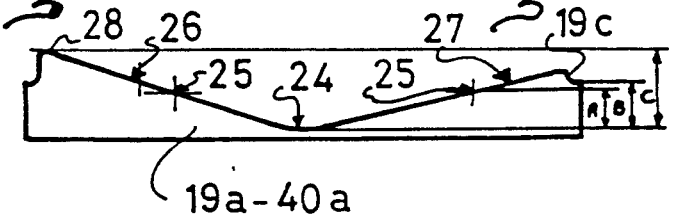
Figure 5:
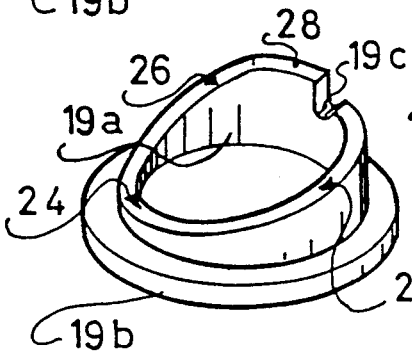
Figure 5A:
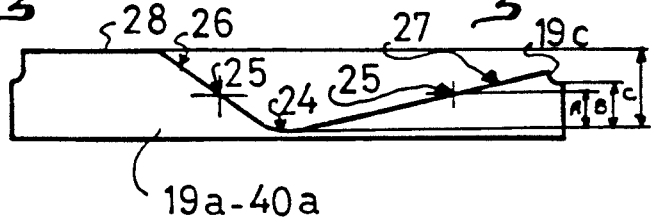

Still according to the invention and as illustrated in FIGS. 4, 4a, 5, and 5a, the cam 19a can also incorporate two dissymmetrical ramps 26 and 27, which extend on either side of the low point 24, one ramp 27 being designed to permit only the stable release manoeuver and the other ramp 26, only the unstable release manoeuver. To this end, the ramp 26 extends in a well-defined manner above the high release point 25 to a level 28, which is determinate of a difference in height "C" between the low 24 and high 25 points greater than the potential pivoting motion of the oscillating lever 11 allowed by construction in the rear part 4. Accordingly, when the cam 19a functions in rotation in the direction corresponding to unstable release, the end 11b of the lever rises on the ramp 26 and passes the high point 25 as it travels toward level 28, while causing the lever 11 to pivot until it is stopped, by means of its end part 11a for example, against the wall 16 of the upper. As soon as the control device 10 is disengaged, the cam 19a tends to return to its original locking position, as described previously. As illustrated in FIGS. 5 and 5a, the slope of the ramp 26 is very pronounced, so that relatively slight pressure of the sensing device, or end 11b, causes, by virtue of the bearing pressure exerted, rotation of the cam 19a until the sensing device becomes stabilized on the low locking point 24.

The release ramp 27 is produced in a manner analogous to that described with reference to FIGS. 2 to 3a.

Figure 6:
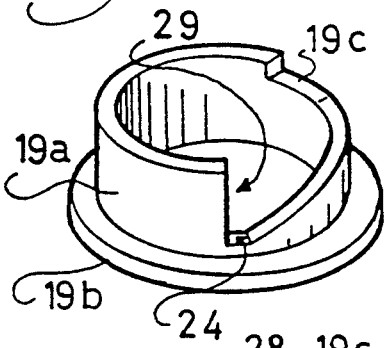
Figure 6A:
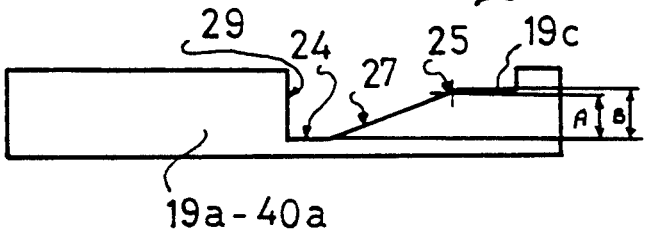

In the example in FIGS. 6 and 6a, the cam 19a is provided in such a way that it can function only in a single direction of rotation. For this purpose, it is fitted with a stop surface 29 extending substantially vertically on one side of the low point 24 opposite a single release ramp 27.

In all embodiments of a cam incorporating dissymmetrical ramps, shown in FIGS. 4 and 5, or of a cam having a single ramp, as in FIG. 6, the stable release ramp 27 can extend equally well in any direction of rotation of the cam and can cover an angled sector of greater or lesser dimension. This last feature is also applicable to ramp 26.

The immobilization devices 35 and 36 just described with reference to FIGS. 1 and 1A block the rear part 4 of the upper 2 of the boot only in the direction of a front-to-back pivoting motion around rivets 6 connecting with the shell base 5. This blocking action is produced because the oscillating levers 11 and 40 comprise lower end sections 11*a* and 40*c* which simply come to rest on this rear part. While remaining within the scope of the invention, it is also possible to consider the production of immobilization devices similar to the devices 35 and 36, but whose oscillating levers 11 and 40 incorporate parts which, by cooperating with a stop on the shell base, also block the rear part 4 of the upper 2 of the boot in the back-to-front direction.

As an example, FIG. 7 illustrates an immobilization device 37 of this kind which incorporates the component parts of the immobilization device 35 in FIG. 1, with the exception of the lower end part 11*a* of the oscillating lever 11. This end section 11*a* assumes the shape of a projection 42 and constitutes a catch piece designed to cooperate with a corresponding stop, or notch 43, in the shell base 5 when the immobilization device 37 is placed in the upper-locking position and when the rear cover 4 is brought into the skiing position. In fact, as long as the rear cover 4 remains pivoted rearward, manipulation of the immobilization device 37 in order to lock it produces only the freedom of the oscillating lever 11 to pivot, and the lower end section 42 of this lever rests, in this position of the rear cover 4, against the outer wall of the shell base, the elastic component then being compressed. In this embodiment, the elastic component 14 is constituted by an elastically-compressible material instead of a helical spring, as shown schematically in FIGS. 1 and 1A.

In FIG. 8, the immobilization device 38 is also of the front-to-back blocking-action type. This device has the same component parts as the immobilization device 36 in FIG. 1A, with the exception of the lower end section 40*c* of the oscillating lever 40, which comprises a catch piece 42 in the same manner as that on the oscillating lever 11 of the device 27 in FIG. 7.

According to another embodiment, the immobilization devices 37 and/or 38 in conformity with the invention can also cooperate with a stop or notch 43A in the shell base 5 extending vertically over a determinate length which is at least greater than the thickness of the catch piece 42, as shown in the example in FIG. 9. In this example, an immobilization device 37 is represented in operative position, the catch piece 42 being engaged in the slot 43A. Since the rear part 4, or rear cover, is centered over the connection rivets 6, it can thus pivot on the rivets within a specific angular value which is a function of the length "H" of the slot 43A extending above the catch piece 42.

Still within the scope of the present invention, the boots may have structures different from the preferred structures described with reference to FIG. 1 or 1A, and they may benefit in similar fashion from an immobilization device 35, 36, 37, or 38, as described above.

Figure 10:
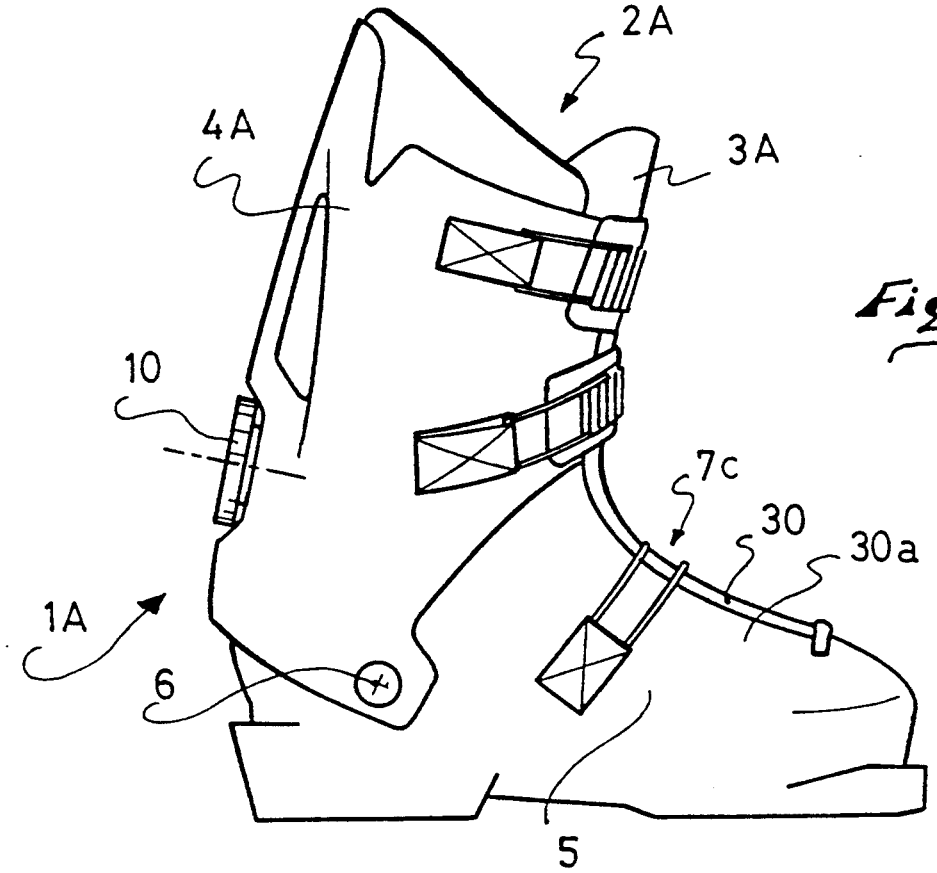
Figure 11:
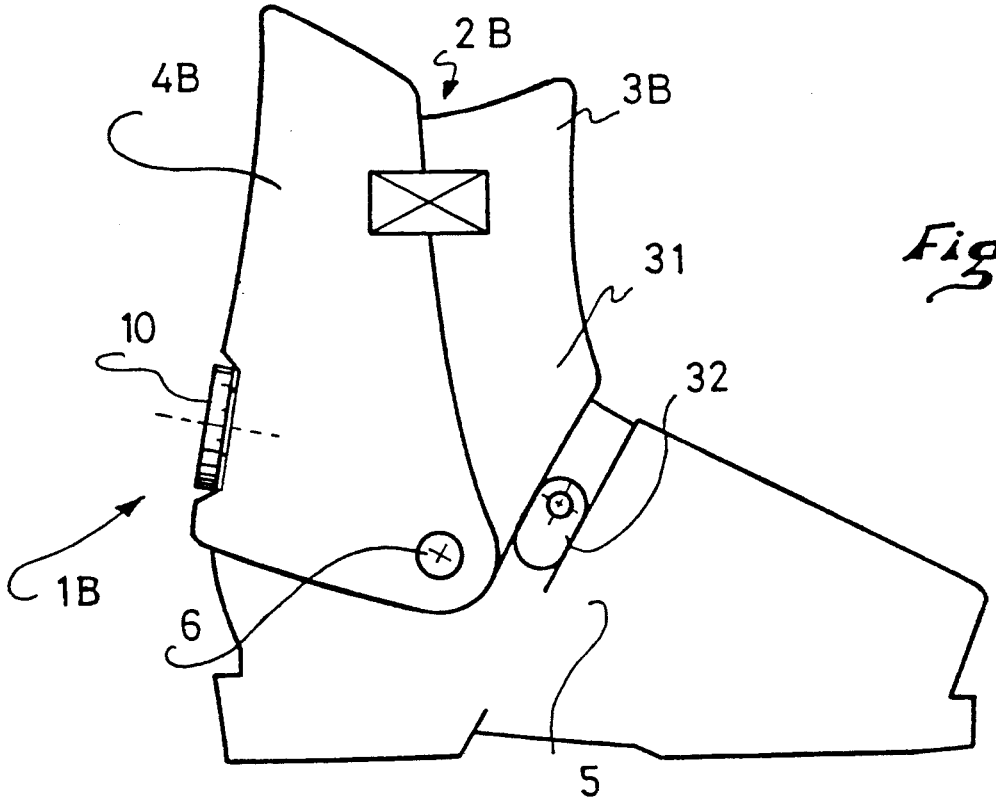

These types of boots may include, in fact:

in FIG. 10, a "mixed entry" or "central entry" boot 1A on which a transverse tongue 30 at least partially covers another tongue 30*a*, these tongues arising from the shell base 5 and belonging to the front part 3A of the upper 2A of the boot 1A. In this boot, both the rear part 4A and the transverse tongues 30 and 30*a* extending over the front upper area of the foot are retractable, thereby allowing, on the one hand, this area to be opened for insertion or removal of the foot by spreading these tongues apart, and, on the other, this area to be closed by covering overlapping the tongue 30 on the tongue 30*a* opposite to it, for example by using a tightening system 7*a*.

in FIG. 11, a "rear entry" type boot. In the example of construction shown, the back-to-front pivoting of the front cover 31 is controlled by a flection-control traveller 32, while the immobilization device blocks the upper in a front-to-back direction.

Figure 12:
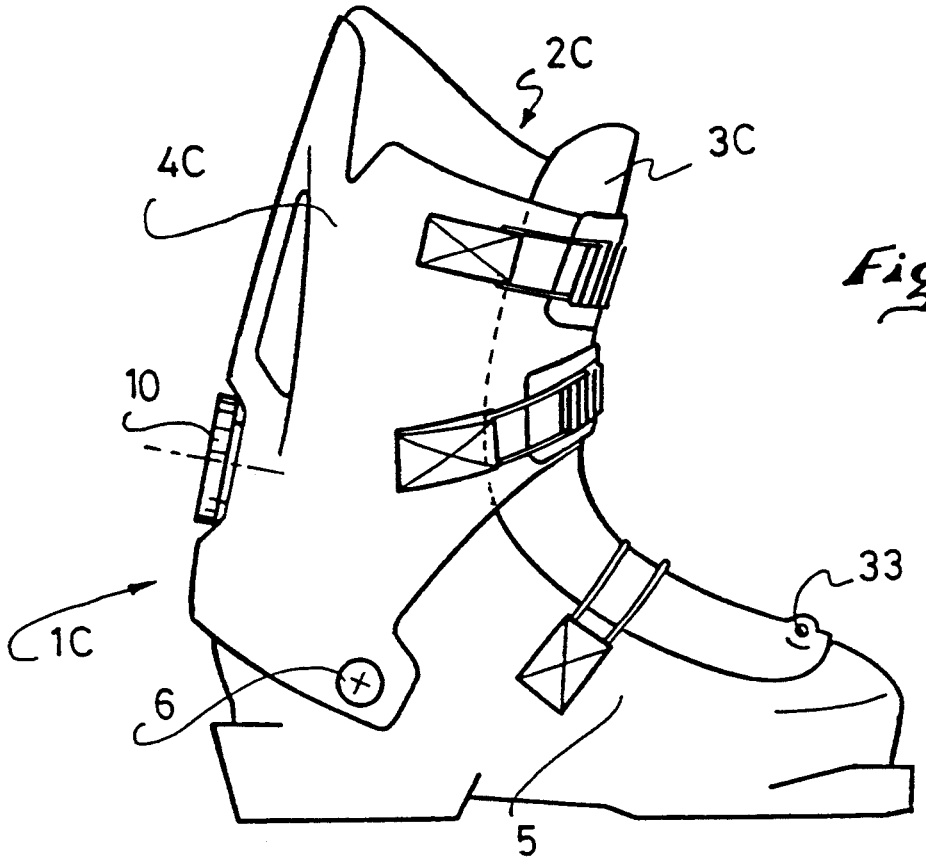
Figure 13:
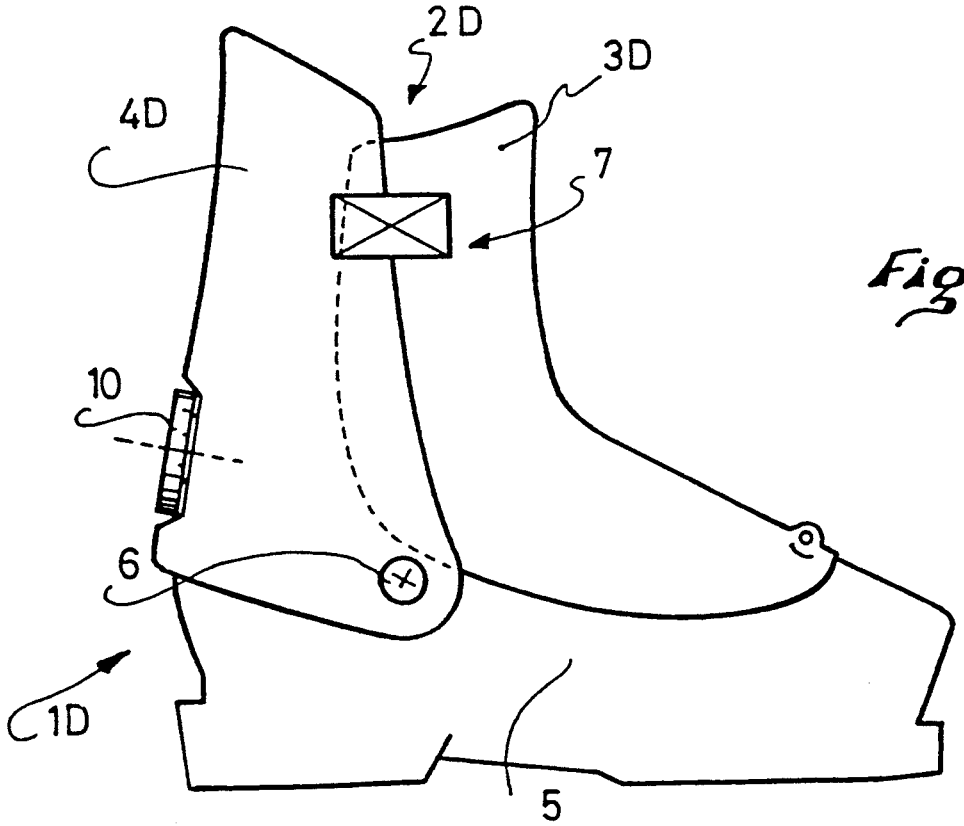

Should there be no traveller, this would, of course, be a "mixed entry" boot whose front and rear covers, 3B and 4B respectively, could be drawn apart simultaneously or individually.

in FIG. 12, a "mixed entry" or "top entry" boot in which the rear cover 4C can be swivelled to the rear, while the front cover 3C, which replaces the overlapping tongues 30 of the boot 1A (FIG. 10), forms a one-piece cover jointed in the area of the tip of the boot 1C by means of a jointed connection piece 33 and whose pivoting movement allows the boot to be put on or taken off.

in FIG. 13, a "mixed entry" or top entry" boot 1D similar to the boot 1C (FIG. 12). However, the means for closing the front cover 3D in conjunction with the rear cover 4D function using tightening means 7 which merely connect these covers 3D and 4D, with no appreciable overlapping of the wings of the rear cover over the front cover, as described with reference to the boots in FIGS. 1 and 1A.

What is claimed is:

1. Alpine ski boot comprising a shell base surmounted by an upper incorporating a front part and a rear part, said rear part of said upper being connected for pivoting movement in rear-to-front and/or front-to-rear directions and comprising a device for immobilization in relation to said shell base for at least one of said rear-to-front and front-to-rear directions of pivoting of said rear part of said upper by means of a stop zone on said shell base, wherein said immobilization device comprises a rotating control mechanism acting on an oscillating lever which pivots around a transverse pin, said control mechanism being capable of turning in a coaxial housing forming a bearing in the rear part of said upper and in which said rotating control mechanism is secured independently of said oscillating lever subjected to the action of a return spring, said rotating device incorporating an outer gripping element and an inner component which, by means of a cam cooperating with a sensing device, acts on said oscillating lever, which is thus secured in its pivoting motion in relation to said stop zone on said shell base.

2. Ski boot according to claim 1, wherein said cam is constituted by a cylindrical part centered on said rotating control mechanism, said part having a cylindrical periphery with at least one progressively-shaped ramp extending from a low point to a high point extended by a position-retention zone, said cam cooperating with said sensing device, to which said oscillating lever is fastened.

3. Ski boot according to claim 2, wherein said cam comprises, beginning at and on both sides of said low point, a gradually rising ramp extending to a position-retention zone common to both of said ramps.

4. Ski boot according to claim 2, wherein said cam comprises, beginning at and on one side of said low point, a gradually rising ramp and, on the other side of said low point, a stop surface against which said sensing device abuts.

5. Ski boot according to claim 2, wherein said cam incorporates, beginning at said low point, two progressive dissymmetrical ramps.

6. Ski boot according to claim 5, wherein said ramp belong to said cam extends beyond said high point and is devoid of a position-retention zone.

7. Ski boot according to claim 1, wherein said cam is constituted by the end of said inner part of said rotating mechanism and secures said oscillating lever in its pivoting motion by means of said end piece of said oscillating lever, which forms said sensing device.

8. Ski boot according to claim 1, wherein said cam is arranged on an intermediate part of said lever, positioned between said transverse pin set in an end of said lever opposite an end cooperating with said stop area on said shell base.

9. Ski boot according to claim 1, wherein said immobilization device incorporates an oscillating lever which comprises an end piece adapted to rest against said stop area of said shell base only when said rear part of said boot upper is drawn in a front-to-back pivoting movement.

10. Ski boot according to claim 1, wherein said immobilization device incorporates an oscillating lever comprising an end piece comprising a catch piece engaging into a corresponding notch when said rear part of said boot upper is brought into skiing position, so as to immobilize said rear part in its pivoting motion in front-to-rear and rear-to-front directions.

11. Ski boot according to claim 1, wherein said notch extends vertically and has a length greater than a thickness of said catch piece, thus giving a value corresponding to a potential pivoting motion of said catch piece in said notch, which determines the freedom of said rear part of said upper to pivot in the rear-to-front direction prior to immobilization.

* * * * *